US005807435A

United States Patent [19]

Poliniak et al.

[11] Patent Number: 5,807,435

[45] Date of Patent: Sep. 15, 1998

[54] SPRAY MODULE HAVING SHIELDING MEANS AND COLLECTING MEANS

[75] Inventors: Eugene Samuel Poliniak, Willingboro, N.J.; Peter Michael Ritt, East Petersburg, Pa.; Brian Thomas Collins; Richard LaPeruta, Jr., both of Lititz, Pa.; Harry Robert Stork, Adamstown, Pa.

[73] Assignee: Thomson Consumer Electronics, Inc., Indianapolis, Ind.

[21] Appl. No.: 816,533

[22] Filed: Mar. 13, 1997

[51] Int. Cl.[6] ..... B05C 11/11

[52] U.S. Cl. ..... 118/504; 118/300; 427/64

[58] Field of Search ..... 430/23–29; 427/64, 427/72; 118/504, 500, 501, 52, 300

[56] References Cited

U.S. PATENT DOCUMENTS

| | | | |
|---|---|---|---|
| 3,558,310 | 1/1971 | Mayaud | 96/36.1 |
| 4,337,304 | 6/1982 | Brenner, Jr. et al. | 427/64 |
| 5,366,758 | 11/1994 | Jang | 427/64 |
| 5,370,952 | 12/1994 | Datta et al. | 430/28 |
| 5,477,285 | 12/1995 | Riddle et al. | 430/23 |
| 5,532,088 | 7/1996 | Teshima et al. | 430/23 |
| 5,554,468 | 9/1996 | Datta et al. | 430/28 |

*Primary Examiner*—David A. Simmons
*Assistant Examiner*—Calvin Padgett
*Attorney, Agent, or Firm*—Joseph S. Tripoli; Dennis H. Irlbeck; Vincent J. Coughlin, Jr.

[57] ABSTRACT

A spray module 40 for manufacturing a cathode-ray tube (CRT) 10 comprises an enclosure 42 having sidewalls 44, a base 46 attached to the sidewalls 44, for closing one end thereof, and a panel support 48 having an opening, 50 therethrough. The panel support 48 is attached to an opposite end of the sidewalls 44. The spray module 40 has at least one electrostatic spray gun 36 therein for spraying charged screen structure material through the opening 50 in the panel support 48 and onto an interior surface of a faceplate panel 12 of the CRT 10. The spray module 40 includes a primary shield assembly 55 disposed within the enclosure 42 and extending through the opening 50 in the panel support 48. A secondary shield assembly 56 also is disposed within the enclosure 42 The primary and secondary shield assemblies 55 and 56, respectively, direct the charged screen structure material toward the interior surface of the panel 12, thereby increasing the transfer efficiency of the spray gun 36. A collecting tray 54 also is utilized to catch the spent spray which falls to the bottom of the spray module 40. The tray 54 is inclined toward a drain 100 that directs the spent material out of the spray module 40.

5 Claims, 6 Drawing Sheets

SPRAY MODULE HAVING SHIELDING MEANS AND COLLECTING MEANS

The invention relates to a spray module used in the manufacturing of a luminescent screen for a cathode-ray tube and, more particularly, to a spray module used in an electrophotographic screening (EPS) process.

BACKGROUND OF THE INVENTION

U.S. Pat. No. 5,554,468, issued on Sep. 10, 1996, to P. Datta et al., discloses electrostatically spraying an organic photoconductive (OPC) solution onto an organic conductive (OC) layer, that was previously deposited onto an interior surface of a CRT faceplate panel. The electrostatic spray guns produce an aerosol of negatively charged, uniform size droplets of the OPC solution which is spray-deposited onto the OC layer. Electrostatic spraying also is utilized for "fixing" the phosphor materials to the OPC layer, by spraying negatively charged droplets of a suitable solvent which softens the OPC layer, thereby permitting the phosphors particles to become at least partially encapsulated therein. Additionally, electrostatic spraying is used for "filming" the screen after "fixing." The filming operation deposits a suitable layer, or film, of material which bridges the irregularities of the phosphor surface to provide a smooth surface onto which an aluminum layer is deposited. A drawback of electrostatic spraying, in each of these uses, is that the electrostatic spray guns have low transfer efficiency, typically less than 20%, thereby increasing both material usage and the time required for deposition of the sprayed material. Transfer efficiency is defined as the quantity of material impinging upon a target divided by the quantity of material dispensed, expressed in percent. Also, the electrostatically charged aerosol droplets splatter on the components of the spray system causing spot defects on the faceplate panel, drip onto the electrostatic guns and overspray onto the walls and other components of the spray module. These drawbacks result in product defects and a decrease in production, because of the additional time needed to clean the spray module and the spray guns. It is desirable to eliminate the foregoing drawbacks in order to reduce the waste of dispersed materials, produce fewer screen defects, and improve transfer efficiency of the spray guns. Because the materials deposited by electrostatic spraying include organic resins and solvents, it also is desirable to continuously collect and remove the spent materials during the spray operation.

SUMMARY OF THE INVENTION

A spray module for manufacturing a cathode-ray tube (CRT) comprises an enclosure closed at one end by a base and having a panel support, with an opening therethrough, at the opposite end. The spray module has at least one electrostatic spray gun therein for spraying charged screen structure material through the opening in the panel support and onto an interior surface of a faceplate panel of the CRT. The spray module includes shielding means disposed within the enclosure and extending through the opening in the panel support. The shielding means directs the charged screen structure material onto the interior surface of the panel, thereby increasing the transfer efficiency of the electrostatic spray gun.

BRIEF DESCRIPTION OF THE DRAWINGS

The invention will now be described in greater detail, with relation to the accompanying drawings in which.

DETAILED DESCRIPTION OF THE PREFERRED EMBODIMENT

Figure 1:
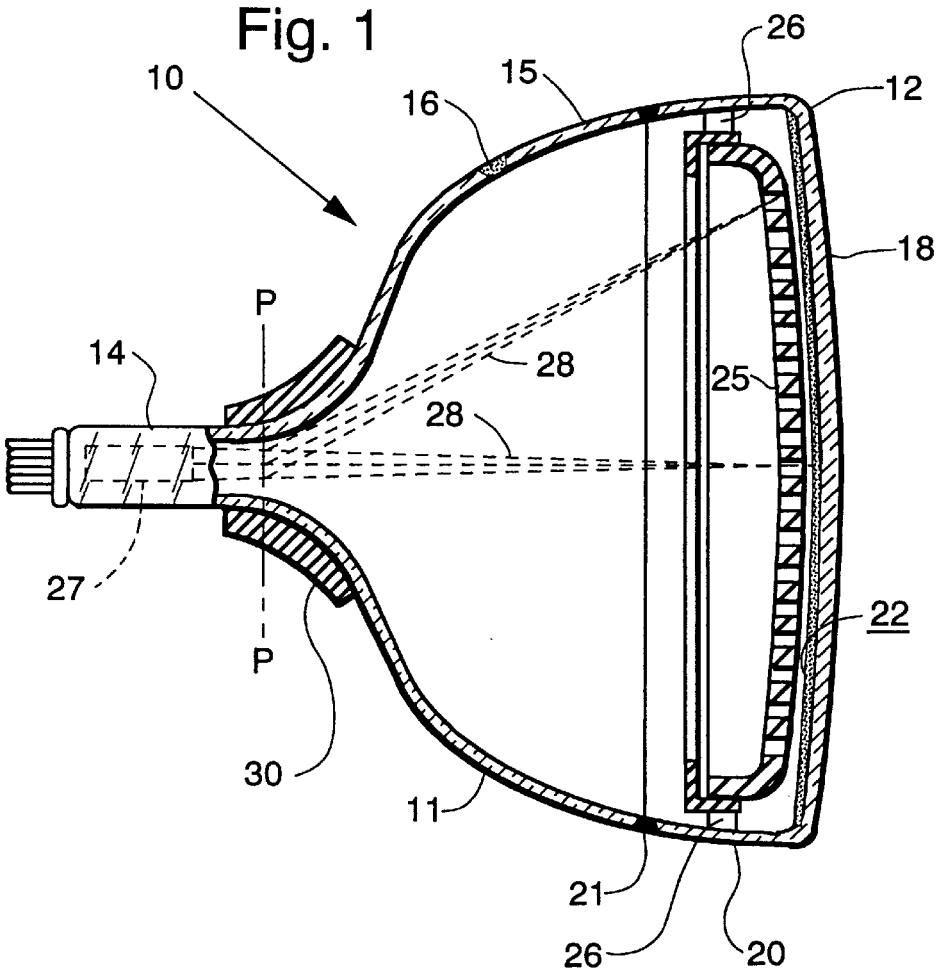
FIG. 1 is a plan view, partially in axial section, of a color CRT made according to the present invention.
Figure 2:
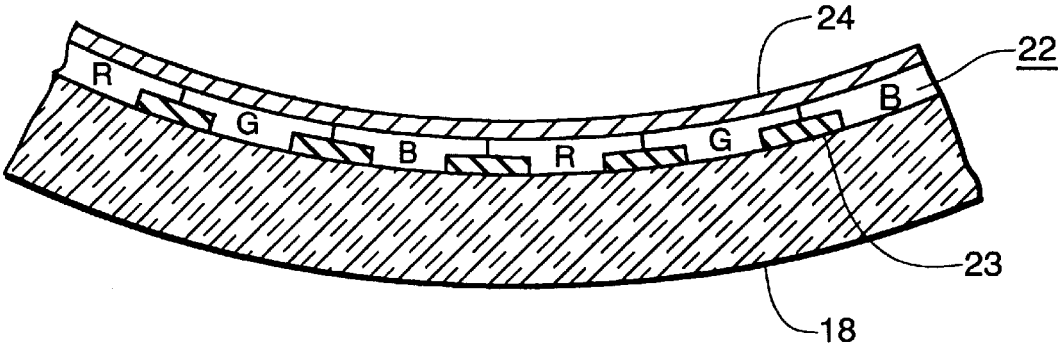
FIG. 2 is a section of a faceplate panel of the CRT of FIG. 1, showing a screen assembly.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen which includes a multiplicity of screen elements comprised of red-emitting, green-emitting, and blue-emitting phosphor stripes R, G, and B, respectively, arranged in color groups or picture elements of three stripes or triads, in a cyclic order. The stripes extend in a direction that is generally normal to the plane in which the electron beams are generated. In the normal viewing position of the embodiment, the phosphor stripes extend in the vertical direction. portions of the phosphor stripes overlap a relatively thin, light absorptive matrix 23, shown in FIG. 2, that is, preferably, of the type formed by the "wet" process, as described in U.S. Pat. No. 3,558,310, issued to Mayaud on Jan. 26, 1971. A dot screen also may be utilized in the CRT. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted in predetermined spaced relation to the screen assembly, using a plurality of studs 26 affixed to the sidewall 20.

An electron gun 27, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line p—p in FIG. 1, at about the middle of the yoke 30. For simplicity, the actual curvatures of the deflection beam paths, in the deflection zone, are not shown.

The screen 22 is manufactured by an electrophotographic screening (EPS) process. Initially, the panel 12 is cleaned by washing it with a caustic solution, rinsing it in water, etching it with buffered hydrofluoric acid and rinsing it again with water, as is known in the art. The interior surface of the viewing faceplate 18 is then provided with the light absorbing matrix 23.

The interior surface of the faceplate 18, having the matrix 23 thereon, is then uniformly coated with a suitable volatilizable, organic conductive material to form an organic conductive (OC) layer 32, shown in FIGS. 3 and 4, which provides an electrode for an overlying volatilizable, organic photoconductive (OPC) layer 34, described hereinafter. Suitable materials for the OC layer 32 include certain quaternary ammonium polyelectrolytes recited in U.S. Pat. Ser. No. 5,370,952, issued on Dec. 6, 1994 to Datta et al. The OC layer 32 has a thickness of about 1 $\mu$m, and is air dried.

The OPC layer 34 is formed by overcoating the dried OC layer 32 with an OPC solution containing polystyrene resin; an electron donor material, such as 1,4-di(2,4methyl-phenyl)-1,4 diphenylbutatriene (2,4-DMPBT); electron acceptor materials, such as 2,4,7-trinitro-9-fluorenone (TNF) and 2-ethylanthroquinone (2-EAQ); a surfactant, such as silicone U-7602; and a mixture of solvents, preferably toluene and xylene. A lasticizer, such as dioctyl phthalate, also may be added to the OPC solution. The surfactant U-7602 is available from Union Carbide, Danbury, CT. The OPC solution, also referred to hereinafter as screen structure material, is applied by means of at least one AEROBELL™ electrostatic spray guns 36, shown schematically in FIG. 3. Two electrostatic spray guns 36 are preferred for spraying the OPC solution onto a 51 cm panel within a application time of 8 seconds, or less, and three such guns also are preferred for panels having a dimension within the range of 89 to 91 cm. The preferred AEROBELL™ model electrostatic spray gun is available from ITW Ransburg, Toledo, OH. The electrostatic spray guns 36 provide negatively charged droplets of OPC solution of uniform size which are spray-deposited onto the OC layer 32. As shown in FIGS. 3 and 4, the panel 12 is oriented with the OC layer 32 directed downwardly, toward the electrostatic guns 36. The OC layer 32 is grounded by means of one of the metal studs 26 during the electrostatic spraying operation so that the negatively charged droplets of the OPC solution are attracted to the more electrically positive OC layer 32. The operating parameters for each of the two AEROBELL™ spray guns (only one of which is shown in FIG. 4) sweeping across the inner surface of the faceplate 18, at a fixed distance of about 14 cm from the seal edge of the panel 12, are as follows: air turbine speed 22,000 rpm; spray gun voltage 70–80 kV; OPC tank pressure, 2.8 kg $cm^{-2}$; and spray-shaping air pressure, about 0.7 kg $cm^{-2}$. Under these electrostatic spraying conditions, about 25 to 40 ml of OPC solution is dispensed from the guns 36. The composition of the present OPC solution consists essentially of between 4.8 to 7.2 wt. % of polystyrene resin; between 0.8 to 1.2 wt. % of 2,4 DMPBT, as the electron donor material; about 0.04 to 0.06 wt. % of TNF and about 0.12 to 0.36 wt. % of 2-EAQ, as electron acceptor materials; about 0.3 wt.% of DOP, as a plasticizer; 0.01 wt. % of silicone U-7602, as a surfactant; and the balance comprising a mixture of toluene and xylene. The toluene concentration in the OPC solution is within the range of 18 to 75 wt.% and the xylene concentration is within the range of 75 to 18 wt. %. If the xylene concentration exceeds this range, the OPC solution will be too wet and will sag, or run, on the panel during drying. The total solid content of the present OPC solution ranges from 6 to 9 wt. %, but a solid content within the range of 7 to 8 wt. % is preferred. In general, as the concentration of solids, such as the resin and the electron donor and acceptor materials, in the solution increases, the concentration of xylene in the solution also should increase, within the above described limits. The OPC layer thickness can be maintained within the range of 5 to 6 $\mu$m by adjusting the spraying parameters.

Figure 3:
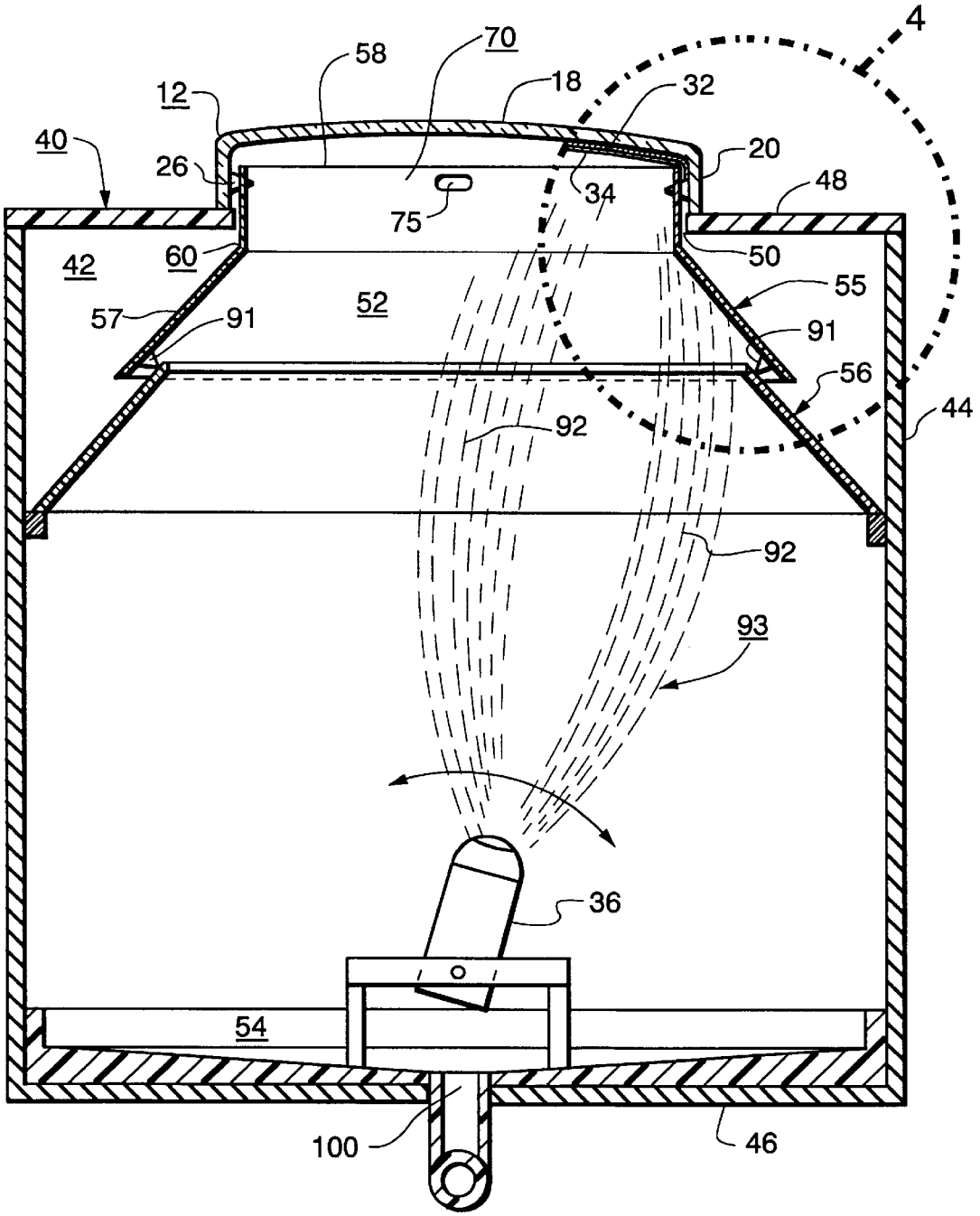
FIG. 3 is a sectional view of a spray module according to the present invention.
Figure 4:
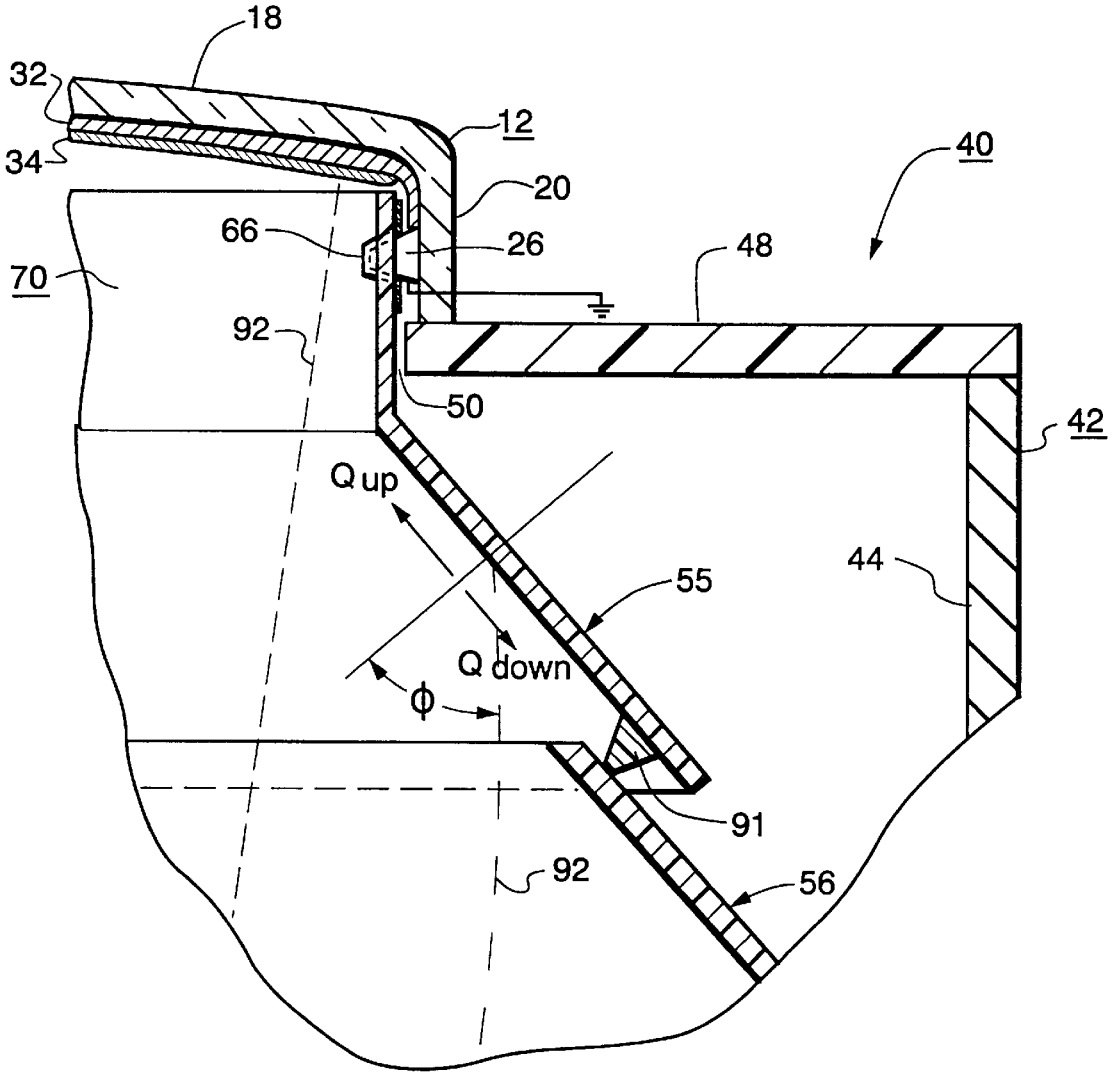
FIG. 4 is an enlarged sectional view the of a portion of the novel shielding means of the present invention within circle 4 of FIG. 3.

An electrostatic spray module 40 is shown in FIGS. 3 and 4. With reference to FIG. 3, the spray module 40 comprises a substantially rectangular enclosure 42 having four sidewalls 44. One end of the enclosure is closed by a base 46 which is attached to one end of the sidewalls. A insulative panel support 48, having an opening 50 therethrough, is attached to an opposite end of the sidewalls 44. At least one electrostatic spray guns 36 is disposed within the spray module 40. The spray module 40 includes a novel shielding means 52 and collecting means 54 disposed within the enclosure 42.

Figure 5:
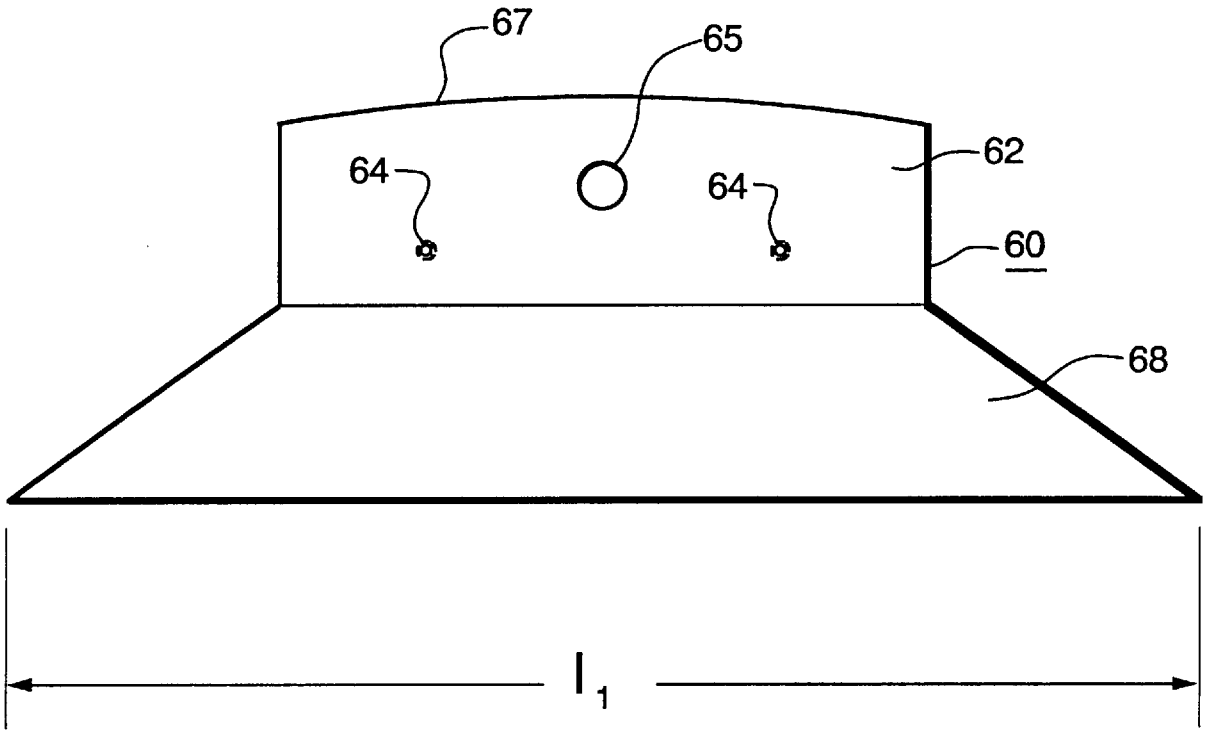
FIG. 5 is a plan view of a first portion of a primary shield assembly.
Figure 6:
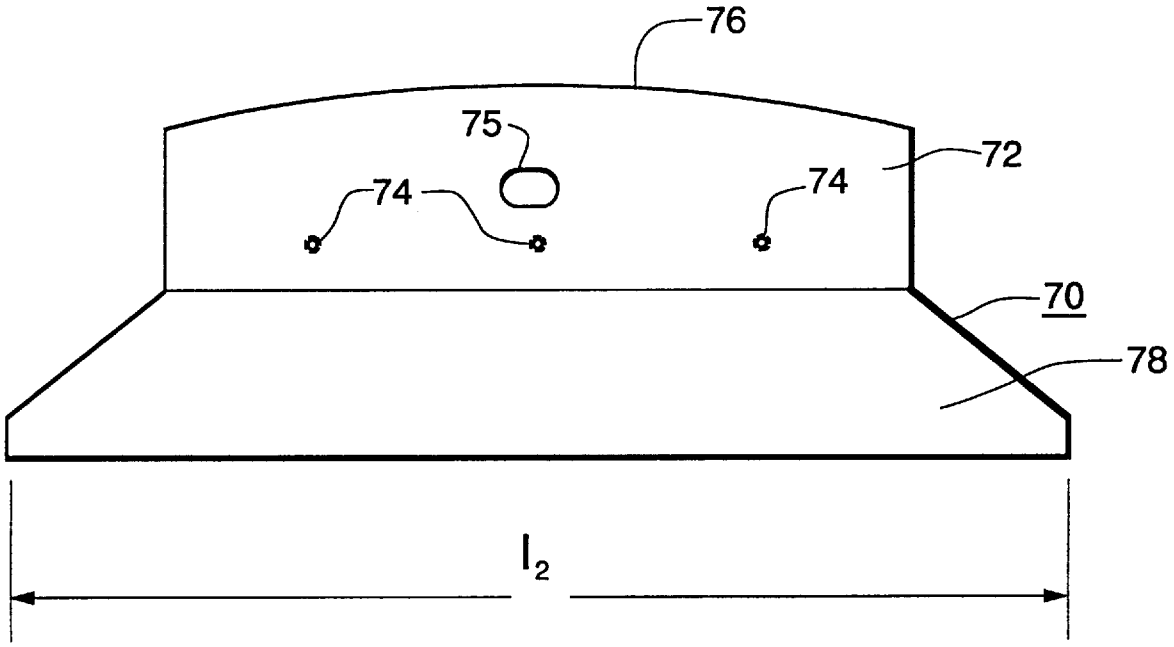
FIG. 6 is a plan view of a second portion of the primary shield assembly.

The shielding means 52 comprises a primary shield assembly 55 and a secondary shield assembly 56. The primary shield assembly 55 includes a first portion 57 disposed partially within the enclosure 42 and a second portion 58 extending through the opening 50 in the panel support 48. The primary shield assembly 55 includes a pair of first shield members 60 and a pair of second shield members 70, one of each pair being shown in FIGS. 5 and 6, respectively. Each of the shield members 60 and 70 is made of an insulative material, such as NYLON™, having a thickness of about 1.6 mm. As shown in FIG. 5, each first shield member 60 has a short sidewall shielding portion 62 that extends through the opening 50 in the panel support 48 and has two screw openings 64 therethrough to facilitate attachment to the panel support 48. A large circular aperture 65, having a diameter of about 19 mm, is formed through the short sidewall shielding portion 62 to accommodate one of the panel studs 26. A thin compliant layer 66, shown in FIG. 4, of an insulative material, such as MYLAR™, is disposed within the aperture 65, to overlie the stud 26 and shield it from the sprayed material and to prevent arcing. Both NYLON™ and MYLAR™ are available from E. I. Dupont, Co., Wilmington, DEl. The upper edge 67 of the short sidewall shielding portion 62 is arcuately shaped and has a radius that conforms to the curvature of the lend radius of the panel 12. For a panel having a diagonal dimension of 51 cm, the radius of the upper edge 67 is about 84.1 cm. The first shield member 60 also includes a short interior portion 68 that is disposed within the enclosure 42 and has a length, $l_1$, of about 51.4 cm. The plane of the short interior portion 68 is formed at an obtuse angle of about 130° to the plane of the short sidewall shielding portion 62. As shown in FIG. 6, each second shield member 70 has a long sidewall shielding portion 72, that extends through the opening 50 in the panel support 48, and three screw openings 74 therethrough to facilitate attachment to the panel support. A large elliptical aperture 75, having a minor axis of about 19 mm and a major axis of about 29 mm, is formed through the long sidewall shielding portion 72 to accommodate a different one of the panel studs 26. The elliptical aperture 75 compensates for variations in the placement of the studs 26. A thin, compliant layer (not shown) of an insulative material, such as MYLAR™ is disposed within the aperture 75 to protect the stud 26, as previously described. The upper edge 76 of the long sidewall shielding portion 72 is arcuately shaped and has a radius that conforms to the curvature of the blend radius of the panel 12. The second shield member 70 also includes a long interior portion 78 that is disposed within the enclosure 42 and has a length, $l_2$, of about 54 cm. The plane of the long interior portion 78 is formed at an obtuse angle of about 130° to the plane of the long sidewall shielding portion 72.

Figure 7:
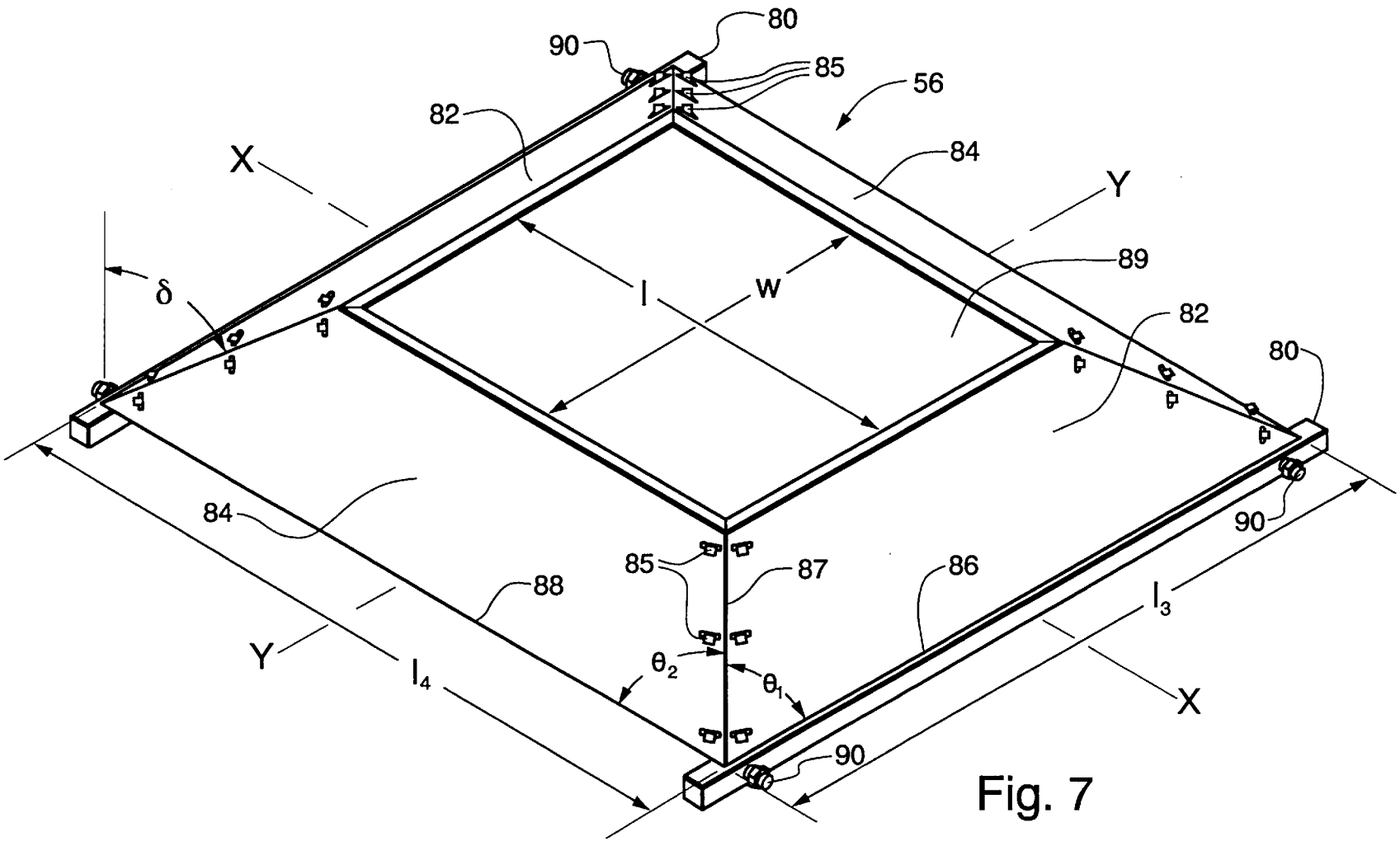
FIG. 7 is a perspective view of a secondary shield assembly of the present invention.

The secondary shield assembly 56, shown in FIG. 7, includes a pair of oppositely disposed support members 80, a pair of minor shield members 82 secured to the support members 80, and a pair of major shield members 84. The minor and major shield members 82 and 84 are secured together, along intersections 87, by screws 85, and form an angle $\delta$, of about 55°, with the vertical. An interior angle $\theta_1$, of 43° 36', is formed between a base 86 of the minor shield member 82 and the intersection 87. The complementary interior angle $\theta_2$ between the intersection 87 and a base 88 of the major shield member 84 is 36° 14'. An opening 89, formed by the minor and major shield members 82 and 84, has a length, l, of about 50.4 cm along the major axis, X and a width, w, of about 42.5 cm along the minor axis, Y. The base 86 of the minor shield member 82 has a length, $l_3$, of about 78.4 cm, while the base 88 of the major shield member 84 has a length, $l_4$, of about 86.4 cm. The support members 80 are secured to two oppositely disposed sidewalls 44 of the enclosure 42 by fasteners 90. The secondary shield assembly 56 partially overlaps the primary shield assembly 55 and is spaced therefrom by a plurality of insulative spacers 91, shown in FIGS. 3 and 4.

In the electrostatic spray module 40, the electrostatic spray guns 36 form a dispersion of negatively charged aerosol particles that are directed along stream lines 92, shown in FIGS. 3 and 4, toward a grounded target, such as OC layer 32 on the interior surface of the faceplate panel 12. The stream lines 92 are generated from a single source, such as the output of the electrostatic spray guns 36. As the spray exits the guns 36, the stream lines 92 form a cone 93, shown in FIG. 3, whose geometry is formed by two competing forces: an outward inertial, i.e., centrifugal, force and the inward force generated by the shaping air exiting the guns 36. The electrostatic repulsive forces between the charged aerosol particles increases the thickness of the wall of the cone 93 as a function of distance from the guns 36. The cone 93 has a substantially vertical force vector supplied by the strong electric field between the guns 36 and the grounded OC layer 32. As any portion of the cone 93 approaches the primary and secondary shield assemblies 55 and 56, respectively, the shield assemblies act as a focusing device. Additionally, conservation of momentum requires that the off-target stream lines 92, i.e., those not propagated directly toward the OC layer 32 on the panel 12, are divided into two groups which are parallel to the shields and counter-propagate each other. That is, one group of stream lines 92 are directed up the shield assemblies, while the other group of stream lines 92 are directed down the shield assemblies. If a bundle of parallel stream lines 92 has a total volumetric flow rate of Q, then the following equation applies, assuming no adsorption:

$$Q=Q_{up}+Q_{down} \quad (1)$$

$Q_{up}$ and $Q_{down}$ are the upward and downward volumetric flow rates along the shield assemblies 55 and 56. By way of example, one stream line 92 is shown in FIG. 4 to be incident on the primary shield assembly 55 with an incident angle $\phi$. The volumetric flow rates for the present spray module are described by the following relationships:

$$Q_{up}=(Q/2)(1+\sin\phi) \quad (2)$$

$$Q_{down}=(Q/2)(1-\sin\phi) \quad (3)$$

where $\phi$ is the angle of incidence, shown in FIG. 4.

It is evident from equations (2) and (3) that:

$$Q_{up}>Q_{down} \quad (4)$$

Thus, after the off-target stream lines 92 are incident on the primary shield assembly 55, the upwardly directed stream lines $Q_{up}$ will be directed toward the grounded OC layer 32 on the panel 12, thereby increasing the transfer efficiency of the spray guns 36 by directing more off-target material toward the panel 12, rather than away from the panel, in the direction, $Q_{down}$. In the absence of the shielding means 52, off-target stream lines 92 would impinge on the lower surface of the panel support 48. In that instance, the momentum balance would not be favorable because the angle between the cone 93 of stream lines 92 and the lower surface of the panel support 48 would be acute. In such a case, the transfer efficiency would not be increased because more off-target material would be directed away from the OC layer 32 on the panel 12 than toward it.

Again with respect to FIG. 3, the collecting means, such as a collecting tray 54, located in proximity to the base 46 of the enclosure 42 is sloped towards a drain 100 that feed directly to an incinerator, not shown, which bums the spent, volatilizable constituents from the spray guns 36. The collecting tray 54 is formed either of NYLON™ or polyethylene that is resistant to the solvents and organic resins in the sprayed material. The slope of the collecting tray 54 permits continuous discharge of the spent spray material that is collected therein, thereby preventing the accumulation of spent material and the emanation of fumes for the spray module. While the invention has been described in the embodiment of the OPC spray module 40, the same shielding means 52 may be utilized in electrostatic spray modules (not shown) for fixing and filming.

What is claimed is:

1. A spray module for use in the manufacturing a cathode-ray tube (CRT) comprising a substantially rectangular enclosure having four sidewalls, a base attached to said sidewalls for closing one end thereof and a panel support, having an opening therethrough, attached to an opposite end of said sidewalls, said spray module having at least one electrostatic spray gun therein for spraying a charged screen structure material onto an interior surface of a faceplate panel of said CRT, shielding means disposed within said enclosure and extending through an opening in said panel support for directing said charged screen structure material toward said interior surface of said panel, thereby increasing the transfer efficiency of said screen structure material from said electrostatic spray gun, said shielding means including:

a primary shield assembly having a first portion disposed partially within said enclosure and a second portion extending through said opening in said panel support to shield said sidewall of said panel; and a secondary shield assembly within said enclosure, said secondary shield assembly at least partially overlapping said first portion of said primary shield assembly.

2. The spray module as described in claim 1, wherein said primary shield assembly includes a pair of first shield members and a pair of second shield members, each of said first shield members having a short sidewall shielding portion extending through said opening in said panel support and a short interior portion disposed within said enclosure, each of second shield members having a long sidewall shielding portion extending through said opening in said panel support and a long interior portion disposed within said enclosure.

3. The spray module as described in claim 2, wherein each short sidewall shielding portion of said first shield members and each long sidewall shielding portion of said second shield members having a panel stud-accommodating opening therethrough.

4. The spray module as described in claim 1, wherein said secondary shield assembly includes a pair of oppositely disposed support members, a pair of minor shield members secured to said support members, and a pair of major shield members secured to said minor shield members.

5. The spray module as described in claim 4, wherein said pair of oppositely disposed support members are secured to two oppositely disposed sidewalls of said enclosure.

* * * * *